United States Patent [19]

Fenton

[11] 4,379,047

[45] Apr. 5, 1983

[54] ADDITIVE FOR GLYCOL SOLVENT USED IN AROMATIC EXTRACTION

[75] Inventor: Donald M. Fenton, Anaheim, Calif.

[73] Assignee: Union Oil Company of California, Los Angeles, Calif.

[21] Appl. No.: 170,635

[22] Filed: Jul. 21, 1980

[51] Int. Cl.[3] ..... C10G 21/16

[52] U.S. Cl. ..... 208/333; 208/323

[58] Field of Search ..... 208/333, 323; 252/387

[56] References Cited

U.S. PATENT DOCUMENTS

| | | | |
|---|---|---|---|
| 3,714,034 | 1/1973 | Kosseim et al. | 208/321 |
| 3,764,548 | 10/1973 | Redmore | 252/188 |
| 3,808,138 | 4/1974 | Yamaguchi | 252/188 |

*Primary Examiner*—Winston A. Douglas
*Assistant Examiner*—William Leader
*Attorney, Agent, or Firm*—Gregory F. Wirzbicki; Dean Sandford

[57] ABSTRACT

Hydrazine is added to glycol solvents utilized for aromatic extraction so that corrosion is minimized while the extractive efficiency of the solvent is maintained.

13 Claims, No Drawings

ADDITIVE FOR GLYCOL SOLVENT USED IN AROMATIC EXTRACTION

BACKGROUND OF THE INVENTION

This invention relates to corrosion control in aromatic extraction units, and more particularly, to a corrosion inhibitor for glycol solvents utilized to selectively extract aromatics from aromatic-aliphatic mixtures.

Glycol is a well-known solvent for preferentially extracting aromatic compounds from a gas or liquid mixture of aromatic and aliphatic compounds. In a typical use, a gas or liquid stream containing aromatic compounds such as benzene, xylene, and toluene and aliphatic components such as propane, butane, pentane, and hexane is brought into intimate contact in an extraction zone with a glycol-water solvent solution containing more than about 90% by weight glycol under conditions such that the aromatic components are selectively extracted into the solvent. A glycol-aromatics extract and a raffinate phase consisting essentially of aliphatic compounds are formed and then separated in a suitable liquid-liquid or gas-liquid separator. The glycol-aromatics extract is directed to a distillation column wherein the desired aromatics are removed by azeotropic distillation from the glycol and recovered as a product. The glycol solvent is also recovered from the distillation column and, being essentially free of aromatics, is recycled as a fresh solvent feed to the extraction zone.

One problem inherent in operating a glycol-aromatic extraction unit is that of corrosion. Oxygen is known to enter the glycol solvent and cause corrosion both by direct reaction with iron in the steel equipment handling the glycol and by reaction with the glycol itself to produce a number of corrosive organic acids. The usual method utilized to combat such corrosion involves the addition of an organic amine, such as ethanolamine, to the glycol solvent, the ethanolamine functioning as a corrosion inhibitor and as an acid neutralizing agent. Although such amines reduce corrosion, it has been found that problems still remain. In particular, it has been found that corrosion still occurs when ethanolamine is utilized as a corrosion inhibitor in locations where the metal surface in contact with the glycol is at an elevated temperature, for example, above about 250° F. Additionally, the corrosion products produced in the glycol solvent have been found to create further problems in that they plug small diameter piping leading to sensitive temperature and pressure control devices, causing operating problems, especially with respect to the operation of the distillation column separating the glycol from the aromatics.

Another problem involved in extracting aromatics with glycol is emulsion formation. Many additives which aid in controlling corrosion in glycol solutions prove undesirable because they tend to promote the formation of emulsions, which substantially lower the extractive efficiency of the glycol solvent, i.e., the emulsions reduce the capability of the glycol for extracting aromatics and thus lower the amount of aromatics produced on a daily basis from an extraction unit operating with a fixed amount of solvent recirculating at a given rate. The presence of emulsions in the glycol solvent often lowers the extractive efficiency of the solvent (and therefore the amount of products produced) by as much as 10 to 20 percent, sometimes even more.

It is an object of the invention, therefore, to provide an additive for glycol solvents utilized to extract aromatics from aromatic-aliphatic mixtures that substantially reduces corrosion without promoting emulsion formation. More specifically, it is an object of the present invention to substantially eliminate corrosion in glycol-aromatic extraction units without affecting the extractive efficiency of the glycol solvent. These and other objects will become apparent in view of the following description of the invention.

SUMMARY OF THE INVENTION

In accordance with the present invention, corrosion problems in equipment utilized to extract aromatic compounds from mixtures of aliphatic and aromatic compounds by means of a glycol solvent are substantially reduced or completely eliminated by introducing hydrazine into the glycol solvent. The extractive efficiency of the solvent is not impaired by the addition of the hydrazine because hydrazine does not promote the formation of emulsions when the glycol solvent is at a pH between about 7 and about 8.

Accordingly, in one embodiment of the invention, there is provided an improved process for extracting aromatic compounds from mixtures of aliphatic and aromatic compounds with a glycol solvent containing a corrosion inhibiting proportion of hydrazine. In another embodiment, the improvement is the use of a hydrazine-containing glycol solvent having a pH between about 7 and about 8. Since it has also been discovered that the presence of hydrazine in glycol solvent solutions prevents corrosion by stifling the formation of peroxides, it is yet another embodiment of the invention to prevent the formation of peroxides in glycol solvent solutions by adding hydrazine to such solutions.

In addition, it has also been found that the formation of peroxides in glycol solvent solutions is catalytically promoted by dissolved iron. Since the process of the invention also reduces or eliminates the dissolved iron content of glycol solvent solutions, it is a further embodiment of the invention to reduce the level of dissolved iron in glycol solvent solutions utilized to preferentially extract aromatics from mixtures of aromatic and aliphatic compounds by adding hydrazine to such glycol solvent solutions.

DETAILED DESCRIPTION OF THE INVENTION

In accordance with this invention, hydrazine ($N_2H_4$) or hydrazine hydrate ($N_2H_4.H_2O$) is introduced into a glycol solvent solution utilized to extract aromatics from a liquid or gas stream containing both aromatic and aliphatic compounds. The typical glycol solvent to which the hydrazine is added comprises more than about 90% by weight of a glycol selected from the group consisting of monoethylene glycol, diethylene glycol, triethylene glycol, tetraethylene glycol, monopropylene glycol, dipropylene glycol, tripropylene glycol, and tetrapropylene glycol. The remainder of the glycol solvent solution usually consists essentially of water, but it may also contain one or more additives known in the art to be beneficial in glycol solvent solutions. Usually, such additives will be present in very small proportions, e.g., less than about 1% by weight of the glycol solution.

In accordance with the invention, hydrazine is added to the glycol solvent solution in an amount such that hydrazine is present in a proportion between about 10 and 1000 wppm, usually between about 25 and 300 wppm. More conveniently, the hydrazine is added such that the pH of the glycol solvent solution is maintained between about 7 and 8, a range which has been found to prevent corrosion without promoting the formation of unacceptable amounts of emulsions lowering the extractive efficiency of the solvent. After hydrazine addition, the preferred glycol solvent solution comprises at least 90% by weight glycol, with at least 85%, most preferably at least 90%, by weight of the balance consisting of water.

Glycol solvent solutions having hydrazine added thereto in accordance with the invention have been found to be highly effective for inhibiting corrosion while not promoting the undesired formation of emulsions. The following Example illustrates the corrosion inhibiting properties of hydrazine in glycol solvent solutions of the kind typically used for aromatics extraction. The Example, however, as with all the Examples herein, is provided for illustrative purposes only and not for the purpose of limiting the scope of the invention, which is defined by the claims.

EXAMPLE I

A glycol solvent solution was prepared and had a composition of 96 wt.% tetraethylene glycol and 4 wt.% water. Three more solutions were prepared like the first, but hydrazine hydrate was added such that one solution contained 87 wppm hydrazine, another 265 wppm, and the last 885 wppm.

The four solutions were then each corrosion tested by a three-day test method designed to provide constant conditions of movement and temperature. The test method is described as follows: a metal coupon is suspended inside a pint bottle containing about three-fourths of its volume full of the solution to be tested, the remainder being occupied with air. The bottle is then rolled on its side at approximately one revolution per second. This is achieved by means of rollers turning at a fixed velocity, thus forcing the metal coupon to move through the solution at a constant velocity. The rollers turn inside an oven maintained at 150° F. so that the solution under consideration is also held at 150° F. during the three days of the test. After calculating the weight loss of the metal coupon, the corrosion rate in mils of an inch per year for each of the four solutions was determined and tabulated in Table I. As shown, the presence of hydrazine in the glycol solvent solution completely inhibited the corrosive properties of the glycol solvent solution.

TABLE I

| Hydrazine Concentration, wppm | Corrosion Rate, mpy |
|---|---|
| 0 | 0.47 |
| 87 | 0.00 |
| 265 | 0.00 |
| 885 | 0.00 |

It is, of course, well-known in the prior art that, for aqueous media (i.e., at least 50% water), hydrazine may be used for corrosion control where oxygen scavenging is important. For example, hydrazine is often utilized in high pressure boilers to scavenge dissolved oxygen in boiler water. But such scavenging requires high temperatures, and in the present invention, oxygen scavenging does not appear to play a significant role in controlling or eliminating corrosion, not only because the glycol solvent is maintained at temperatures no greater than about 375° F., but also because oxygen and hydrazine have been found to co-exist in samples of glycol solvent solution removed from a commercial operation in which tetraethylene glycol was utilized to extract benzene, toluene, and xylene from a liquid also containing aliphatic compounds. Hydrazine thus appears to prevent corrosion by a different mechanism than oxygen scavenging in glycol solvent solutions, and it is believed that corrosion is prevented in the process of the invention by preventing the formation of (and/or eliminating the presence of) soluble iron and hydroperoxides in glycol solvent solutions. As stated previously, it is known that corrosion proceeds in conventional aromatic extraction processes utilizing glycol solvent solutions by the degradation of the glycol, forming acids by reaction with oxygen. But it is believed that the overall conversion of glycol to the acids by reaction with oxygen proceeds through the formation of one or more intermediate hydroperoxide compounds, according to the following respresentative reaction:

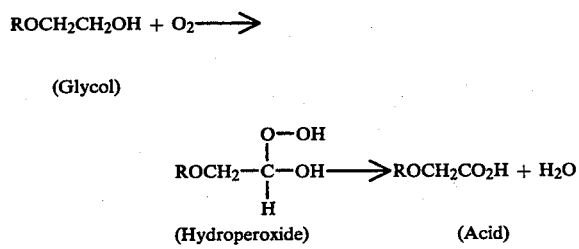

That hydroperoxide intermediates form in glycol solvent solutions was proven when a sample of such a solution taken from a commercial glycol-aromatic extraction unit was analyzed by appropriate analytical technique and found to contain 0.33 milliequivalents per liter of active oxygen, that is, oxygen in the form of peroxides only. (The test method for determining active oxygen (or peroxides) comprises adding an excess of ferrous thiocyanate to a sample of glycol solvent solution to convert all peroxides therein to ferric thiocyanate, following which the sample is titrated with titanium trichloride until the red color disappears. The milliequivalents of titanium trichloride utilized equals the milliequivalents of peroxides as were originally present in the sample. The number of milliequivalents per liter of peroxides (or active oxygen) as determined by the foregoing test procedure is usually referred to as the "peroxide number.") Because the glycol solution in which the peroxides were detected also contained 2.4 wppm of dissolved iron, it was suspected that dissolved iron was acting as a catalyst for the conversion of glycol to peroxides, a suspicion that was confirmed when the experiment described in the following example was run.

EXAMPLE II

A glycol solvent solution (96 wt.% tetraethylene glycol-4 wt.% water) removed from a commercial operation in which the glycol solution was utilized to extract aromatics from a liquid also containing aliphatic compounds contained 2.4 wppm of dissolved iron and had a peroxide number of 0.33. A sample of such a solution was held for 4 hours at 150° C. while air was bubbled into the solution. At the end of the test, the solution was found to still contain 2.4 wppm of dissolved iron and to have a peroxide number of 0.33. Another sample of the glycol solution, to which had been added sufficient ferric chloride to provide 2.0 grams per liter of ferric chloride, not all of which dissolved, was subjected to the same test as the previous sample and subsequently found to contain 301 wppm of dissolved iron and have a peroxide number of 6.1. The large increase in the peroxide number was evidence that dissolved iron was a catalyst promoting the conversion of tetraethylene glycol to the corresponding hydroperoxide.

The effect of hydrazine on the dissolved iron and hydroperoxides in glycol solvent solutions is shown in the following example.

EXAMPLE III

Hydrazine hydrate (0.5 ml) was added to a 75 ml sample of a glycol solvent solution as described in Example II containing 2.4 wppm of dissolved iron and having a peroxide number of 0.33. The hydrazine-glycol solvent solution was then heated for 4 hours under a nitrogen atmosphere, and after analysis by appropriate techniques, was found to contain no detectable iron and to have a peroxide number less than 0.1. These data establish that hydrazine removes dissolved iron, the catalyst for the conversion of glycols to corresponding peroxides, and also removes peroxides, the intermediates leading to the formation of corrosive carboxylic acids.

The results of the experiment described in the foregoing Example III indicate that the iron content of glycol solvent solutions utilized in a commercial aromatic extraction unit may be maintained at extremely low levels, as for example, below 1 wppm. At such levels, the degradation of the glycol solution by the conversion of glycol to corrosive carboxylic acids is minimized.

Although the invention has been described in conjunction with illustrative Examples, it is evident that many alternatives, modifications, and variations will be apparent to those skilled in the art in light of the foregoing description. Accordingly, it is intended to embrace all such alternatives, modifications, and variations as fall within the spirit and scope of the appended claims.

I claim:

1. In a process for treating a fluid mixture of aromatic compounds and aliphatic compounds wherein the fluid mixture is contacted with a glycol solvent solution containing water and a glycol under conditions such that said aromatic compounds are selectively extracted into said solvent, and a glycol-aromatics extract is separated from an aliphatic raffinate, and said extract is separated into glycol and aromatic compounds, with said glycol being recycled to contact said fluid mixture, the improvement comprising reducing the concentration of peroxides formed in said solution by adding hydrazine to said glycol solvent solution and heating the resultant admixture.

2. In a process for treating a fluid mixture of aromatic compounds and aliphatic compounds wherein the fluid mixture is contacted with a glycol solvent solution containing water and a glycol under conditions such that said aromatic compounds are selectively extracted into said solvent, and a glycol-aromatics extract is separated from an aliphatic raffinate, and said extract is separated into glycol and aromatic compounds, with said glycol being recycled to contact said fluid mixture, the improvement comprising reducing the concentration of dissolved iron formed in said glycol solvent solution by adding hydrazine to said glycol solvent solution and heating the resultant admixture.

3. A process as defined in claim 1 or 2 wherein said hydrazine is added in the form of hydrazine hydrate.

4. A process as defined in claim 1 or 2 wherein said glycol in said glycol solvent solution is selected from the group consisting of monoethylene glycol, diethylene glycol, triethylene glycol, tetraethylene glycol, monopropylene glycol, dipropylene glycol, triethylene glycol, and tetraethylene glycol.

5. A process as defined in claim 1 or 2 wherein said hydrazine is present in a proportion such that essentially no emulsions form in said glycol solvent solution.

6. A process as defined in claim 1 or 2 wherein said glycol solvent solution after hydrazine addition contains at least 90% by weight glycol with the balance consisting essentially of water and hydrazine.

7. A process as defined in claim 1 or 2 wherein said glycol solvent solution comprises at least 90% by weight glycol, with the balance comprising at least 90% water.

8. A process as defined in claim 1 or 2 wherein said glycol solvent solution contains at least about 25 wppm of hydrazine.

9. A process as defined in claim 1 wherein said peroxides include a hydroperoxide.

10. In a process for treating a fluid mixture of aromatic compounds and aliphatic compounds wherein the fluid mixture is contacted with a glycol solvent solution containing water and a glycol under conditions such that said aromatic compounds are selectively extracted into said solvent, and a glycol-aromatics extract is separated from an aliphatic raffinate, and said extract is separated into aromatic compounds and glycol, with said glycol being recycled to extract more aromatics from said fluid mixture, the improvement comprising reducing the concentrations of dissolved iron and hydroperoxide formed in said glycol solvent solution by adding hydrazine and heating the resultant admixture.

11. A process as defined in claim 1, 2, or 10 wherein hydrazine is added to said glycol solvent solution such that said hydrazine is present in a proportion between about 10 and 1000 wppm.

12. A process as defined in claim 1, 2, or 10 wherein hydrazine is added to said glycol solvent solution such that hydrazine is present in a proportion between about 25 and 300 wppm.

13. A process as defined in claim 1, 2, or 10 wherein said glycol solvent solution is maintained at a temperature no greater than about 375° F.

* * * * *